US005895209A

United States Patent [19]

Miyazawa

[11] Patent Number: 5,895,209

[45] Date of Patent: Apr. 20, 1999

[54] VARIABLE CAPACITY PUMP HAVING A VARIABLE METERING ORIFICE FOR BIASING PRESSURE

[75] Inventor: Shigeyuki Miyazawa, Saitama, Japan

[73] Assignee: Jidosha Kiki Co., Ltd., Tokyo, Japan

[21] Appl. No.: 08/808,478

[22] Filed: Mar. 3, 1997

[30] Foreign Application Priority Data

Apr. 8, 1996 [JP] Japan ..... 8-085090

[51] Int. Cl.[6] ..... F04C 2/344; F04C 15/02

[52] U.S. Cl. ..... 418/26; 418/27; 418/30

[58] Field of Search ..... 418/26, 27, 30; 417/220

[56] References Cited

U.S. PATENT DOCUMENTS 3,656,869 4/1972 Leonard ..... 417/220
5,562,432 10/1996 Semba et al. ..... 418/30

FOREIGN PATENT DOCUMENTS 53-130505 11/1978 Japan .
56-143383 11/1981 Japan .
58-93978 6/1983 Japan .
63-14078 4/1988 Japan .
7-243385 9/1995 Japan .

*Primary Examiner*—John J. Vrablik
*Attorney, Agent, or Firm*—Blakely Sokoloff Taylor & Zafman

[57] ABSTRACT

A variable capacity pump includes a rotor, a plurality of vanes, a cam ring, a spring, a variable orifice, first and second fluid pressure chambers, and first and second openings. The spring biases the cam ring to a position where a volume of the pump chamber of a portion ranging from a pump suction region to a pump discharge region becomes maximum. The variable metering orifice is formed midway along a discharge passage of a pressure fluid discharged from the pump chamber. The first and second fluid pressure chambers are formed between the outer circumferential portion of the cam ring and the inner circumferential surface of the pump body to be divided in a biasing direction of the cam ring, and swing the cam ring upon introduction of input and output fluid pressures of the metering orifice thereto. The first and second openings respectively open to the pump suction region and the pump discharge region of the pump chamber to have opening areas that are changed by a swing of the cam ring. At least the second opening is formed in a range where a portion thereof opposing the first fluid pressure chamber is wider than a portion thereof opposing the second fluid pressure chamber.

4 Claims, 8 Drawing Sheets

VARIABLE CAPACITY PUMP HAVING A VARIABLE METERING ORIFICE FOR BIASING PRESSURE

BACKGROUND OF THE INVENTION

The present invention relates to a variable capacity vane pump used in a pressure fluid utilizing equipment, e.g., a power steering system that decreases the steering wheel control force of an automobile and, more particularly, to a variable capacity pump which, in a loaded state accompanying the operation of a pressure fluid utilizing equipment, performs flow rate control in response to the load pressure.

Generally, a capacity vane pump directly driven and rotated by an automobile engine is used as a pump for a power steering system. In this capacity pump, the discharge flow rate increases or decreases in accordance with the engine speed. Thus, this capacity pump has characteristics opposite to the auxiliary steering force of the power steering system which increases while the automobile stops or travels at a low speed and decreases while the automobile travels at a high speed. A capacity pump having a large capacity must be used that can assure a discharge flow rate enough to obtain a necessary auxiliary steering force even in low-speed travel with a low engine speed. For high-speed travel at a high engine speed, a flow control valve for controlling the discharge flow rate to a predetermined amount or less is indispensable. For these reasons, in the capacity pump, the number of components is increased and the structure and the arrangement of the passages are complicated, inevitably leading to an increase in size and cost of the pump as a whole.

In order to solve these inconveniences of the capacity pump, many variable capacity vane pumps capable of decreasing the discharge flow rate per revolution (cc/rev) in proportion to an increase in engine speed are proposed in, e.g., Japanese Patent Laid-Open Nos. 53-130505, 56-143383, and 58-93978, Japanese Utility Model Publication No. 63-14078, and Japanese Patent Laid-Open No. 7-243385. In these variable capacity pumps, a flow control valve as that needed in the capacity vane pump is not required, the waste in drive horsepower is prevented to improve the energy efficiency, a return flow to the tank is absent to prevent an oil temperature increase, and problems such as leakage in the pump and a decrease in volumetric efficiency can be prevented.

An example of such a variable capacity vane pump will be briefly described with reference to FIG. 8 showing the pump structure of Japanese Patent Laid-Open No. 7-243385. Reference numeral 1 denotes a pump body; 1*a*, an adapter ring; and 2, a cam ring. The cam ring 2 can swing and displace in an elliptic space portion 1*b* formed in the adapter ring 1*a* of the pump body 1 through a support shaft portion 2*a* as the swing center. A biasing force is applied to the cam ring 2 by a coil spring serving as a press means (not shown) in the direction of an arrow F.

A rotor 3 is housed in the cam ring 2 to be eccentric to one side such that it forms a pump chamber 4 on the other side. When the rotor 3 is driven and rotated by an external drive force, vanes 3*a* held to be radially movable back and forth are moved back and forth. A drive shaft 3*b* drives the rotor 3 to rotate in the direction of an arrow.

Reference numerals 5 and 6 denote a pair of high- and low-pressure fluid pressure chambers formed on the two sides of the outer circumferential portion of the cam ring 2 in the elliptic space portion 1*b* of the adapter ring 1*a* of the pump body 1. Passages 5*a* and 6*a* respectively open to the fluid pressure chambers 5 and 6 through a spool type control valve 10 (to be described later). The passages 5*a* and 6*a* guide the input and output fluid pressures of a variable orifice 12 formed in a pump discharge passage 11 as control pressures for swinging and displacing the cam ring 2. When the input and output fluid pressures of the variable orifice 12 of the pump discharge passage 11 are introduced to the cam ring 2 through these passages 5*a* and 6*a*, the cam ring 2 is swung and displaced in a required direction to change the volume in the pump chamber 4, thereby controlling the discharge flow rate in accordance with the pump discharge flow rate. In other words, the discharge flow rate control is performed such that the discharge flow rate is decreased with an increase in pump speed.

A pump suction opening (suction port) 7 opens to a pump suction region 4A of the pump chamber 4, and a pump discharge opening (discharge port) 8 opens to a pump discharge region 4B of the pump chamber 4. These openings 7 and 8 are formed in either one of a pressure plate and a side plate (neither are shown) that serve as fixing wall portions for holding pump constituent elements comprising the rotor 3 and the cam ring 2 by sandwiching them from the two sides.

The biasing force is applied to the cam ring 2 by a coil spring from the fluid pressure chamber 6, as indicated by F in FIG. 8, to normally maintain the volume in the pump chamber 4 to the maximum. Seal members 2*b* are formed in the outer circumferential portion of the cam ring 2 to separately form the fluid pressure chambers 5 and 6 on their right and left sides together with the support shaft portion 2*a*.

Hair-like notches 7*a* and 8*a* are formed continuous to the terminal end portions of the pump rotational directions of the pump suction opening 7 and the pump discharge opening 8, respectively. When the distal ends of the vanes 3*a* come into slidable contact with the inner circumferential portion of the cam ring 2 during rotation of the rotor 3 to perform a pumping operation, the notches 7*a* and 8*a* gradually relieve the fluid pressure from the high pressure side to the low pressure side between a space formed between the two vanes 3*a* close to the end portions of the openings 7 and 8 and a space formed between the two vanes 3*a* adjacent to the vanes 3*a* described above, so that a surge pressure and pulsation caused by the surge pressure are decreased.

The spool type control valve 10 is actuated by a difference pressure between the input pressure and the output pressure of the variable metering orifice 12 formed midway along the pump discharge passage 11. A fluid pressure corresponding to the pump discharge flow rate is introduced from the control valve 10 to the high-pressure fluid pressure chamber 5 outside the cam ring 2, to maintain a sufficient flow rate at the initial stage of pumping operation. Especially during a loaded state caused by the operation of the pressure fluid utilizing equipment, when the difference pressure between the input pressure and the output pressure of the variable orifice 12 becomes equal to or higher than a predetermined value, this control valve 10 introduces the output fluid pressure of the variable orifice 12 as a control pressure to the high-pressure fluid pressure chamber 5 outside the cam ring 2. Thus, even when unbalanced forces act due to the non-equilibrium fluid pressures inside and outside the cam ring 2, e.g., even when a force that decreases the discharge flow rate from the pump acts, this acting force can be canceled, thereby preventing swing of the cam ring 2.

In other words, in this spool type control valve 10, the pump suction opening 7 and the pump discharge opening 8, that open to the pump chamber 4 on the two sides of the swing direction as the support shaft portion 2*a* serving as the swing fulcrum of the cam ring 2 as the center, are arranged in an unbalanced state in the structure of the variable capacity pump described above. A control operation is performed so that the cam ring 2 will not be swung about the support shaft portion 2*a* as the center by the right and left unbalanced forces generated due to the position of the pump discharge opening 8.

This will be described in detail. In the pump cartridge (pump actuating portion) having the pump constituent elements, e.g., the rotor 3, the cam ring 2, and the like, of the vane pump as described above, small chambers (chambers partitioned by two vanes 3*a*) located in intermediate regions (portions in FIG. 8 where the openings 7 and 8 do not exist) corresponding to a region extending from the end point of the suction region 4A to the start point of the pump discharge region 4B of the pump chamber 4 and a region extending from the end point of the pump discharge region 4B to the start point of the suction region 4A change alternately to the pump discharge pressure and the pump suction pressure.

When a vane 3*a* preceding in the rotating direction of the rotor 3 reaches the opening 8 or 7 at the leading end in the rotational direction, a small chamber formed by this vane 3*a* and a following vane 3*a* is set at the pump discharge or suction port pressure of the corresponding one of the openings 7 and 8. When this following vane 3*a* is located at the opening 7 or 8 at the trailing end in the rotational direction, the small chamber is set at the pump discharge or suction port pressure of the opening 8 or 7.

Accordingly, in this variable capacity vane pump, the position where the small chamber set at the high-pressure pump discharge pressure corresponds to two regions indicated by $\theta 1$ and $\theta 2$ ($\theta 1<\theta 2$) on the left and right sides of a line segment extending through the centers of the support shaft portion 2*a* and drive shaft 3*b* in FIG. 8. In these pump discharge region portions, the right and left portions about the line segment extending through the support shaft portion 2*a* described above as the center become unbalanced. In particular, when such unbalanced forces act on the cam ring 2, the higher the pump discharge pressure, the more inconveniences appear.

The pump discharge pressure increases in a loaded state, e.g., during steering wherein a power steering system PS serving as a pressure fluid utilizing equipment operates, or when the pump speed increases even if no load acts. In such a loaded state and the like, when the pump discharge pressure increases, the cam ring 2 swings in a direction to reduce the pump chamber 4 (to the right in FIG. 8) due to the pressure difference among the internal pressure in the cam ring 2 and the pressures in the outer fluid pressure chambers 5 and 6. When the cam ring 2 swings in this manner, the pump chamber 4 reduces during the loaded state that requires a discharge flow rate, so that the discharge pressure and the discharge flow rate decrease.

The spool type control valve 10 is formed to decrease a fluid pressure P3 of the fluid introduced to the high-pressure fluid pressure chamber 5 outside the cam ring 2, to be lower than a pressure P1 on the upstream of the variable orifice 12 in the pump discharge passage 11, so that the cam ring 2 will not be swung or displaced even by the unbalanced forces (described above) during the loaded state of the cam ring 2. A pressure P2 on the downstream of the variable orifice 12 is introduced to the low-pressure fluid pressure chamber 6 outside the cam ring 2. This pressure P2 is lower than the pressure P1 described above and higher than the pressure P3.

According to the variable capacity vane pump having the arrangement described above, since unnecessary swing and displacement of the cam ring 2 occurring during the loaded state are prevented in accordance with fluid pressure control by providing the control valve 10, the structure of the entire pump becomes complicated. When this control valve 10 is used, the leakage amount of the fluid in the pump becomes large.

In this conventional structure, even in the unloaded state, the larger the pump speed, the higher the discharge pressure. Thus, the control valve 10 performs flow rate control similar to that in the loaded state described above. In the unloaded state, however, the flow rate is excessively large, and the pump drive torque also increases. For example, in a variable capacity vane pump applied to a power steering system, the effect of decreasing the load to the engine is small, and accordingly the fuel consumption cannot be improved much better than in the conventional system.

In particular, when a variable capacity pump of this type is compared with a capacity vane pump, one of the purposes is to eliminate a valve that performs flow rate control. To use the spool type control valve 10 as described above for controlling the fluid pressures to be supplied to the fluid pressure chambers 5 and 6 outside the cam ring 2 is against this purpose. Therefore, strong demand has arisen for solving the inconveniences caused by the unbalanced forces acting on the cam ring during the loaded state as described above by using a different scheme.

SUMMARY OF THE INVENTION

It is an object of the present invention to provide a variable capacity pump capable of decreasing a pump drive torque during an unloaded state to the minimum.

It is another object of the present invention to provide a variable capacity pump in which a spool type control valve is unnecessary to simplify the structure.

In order to achieve the above objects, according to the present invention, there is provided a variable capacity pump comprising a rotor rotatable in a pump body, a plurality of vanes formed radially on an outer circumferential portion of the rotor and held to be movable back and forth, a cam ring fitted on the rotor to form a pump chamber on a one-side portion of the outer circumferential portion of the rotor and swingable in the pump body, the pump chamber being divided into a plurality of small chambers by an inner circumferential surface of the pump body and two adjacent ones of the vanes, biasing means for biasing the cam ring to a position where a volume of the pump chamber of a portion ranging from a pump suction region to a pump discharge region becomes maximum, variable metering orifice formed midway along a discharge passage of a pressure fluid discharged from the pump chamber, first and second fluid pressure chambers formed between the outer circumferential portion of the cam ring and the inner circumferential surface of the pump body to be divided in a biasing direction of the cam ring, to swing the cam ring upon introduction of input and output fluid pressures of the metering orifice thereto, and first and second openings respectively open to the pump suction region and the pump discharge region of the pump chamber, to have opening areas that are changed by a swing of the cam ring, at least the second opening being formed in a range where a portion thereof opposing the first fluid pressure chamber is wider than a portion thereof opposing the second fluid pressure chamber.

DESCRIPTION OF THE PREFERRED EMBODIMENT

The present invention will be described in detail with reference to the accompanying drawings.

FIGS. 1 to 7 show a variable capacity pump according to an embodiment of the present invention. A case wherein the variable capacity pump is a vane type oil pump serving as the hydraulic source of a power steering system will be described with reference to FIGS. 1 to 7.

Figure 5:
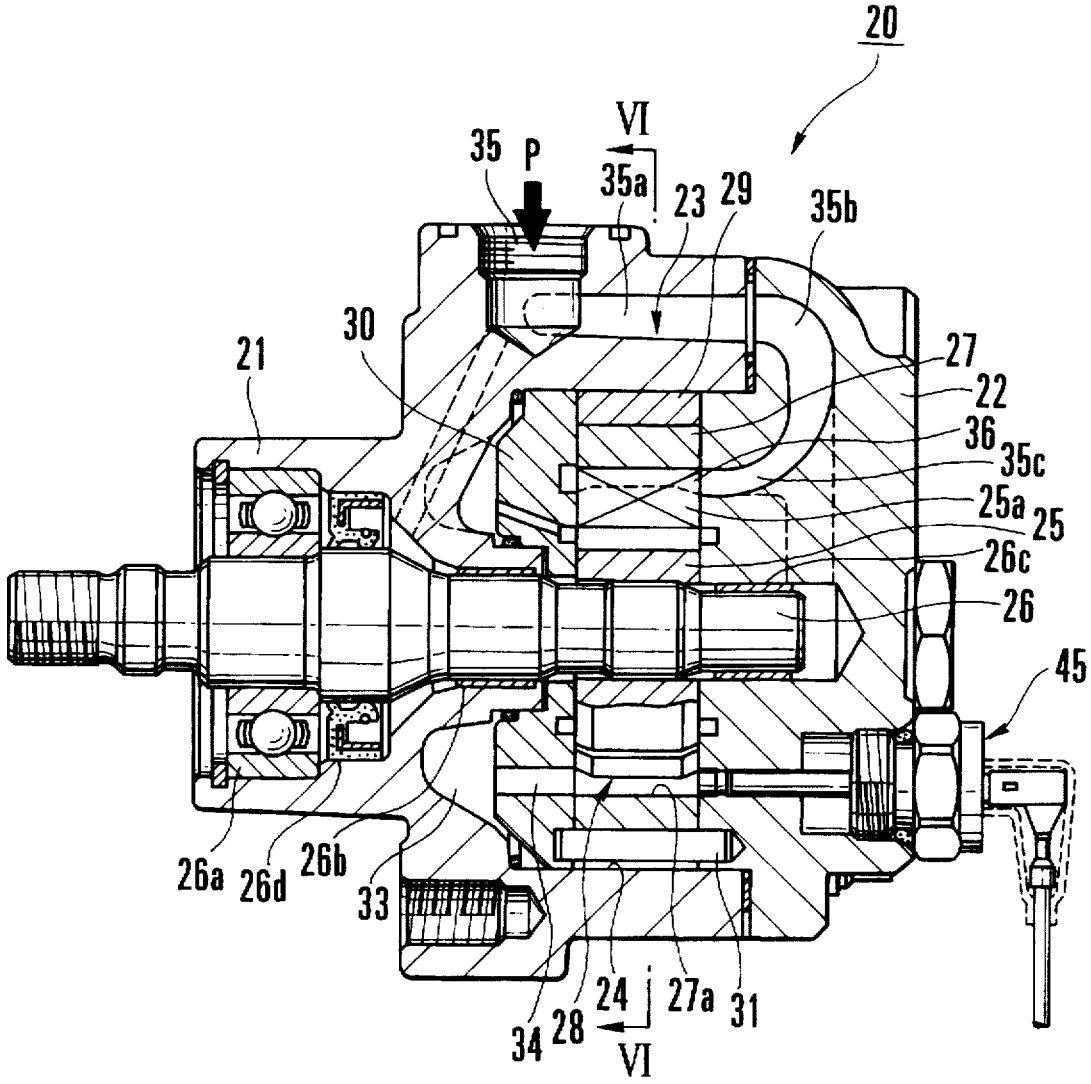
FIG. 5 is a cross-sectional view showing the structure of the main part of a variable capacity pump according to an embodiment of the present invention.

In FIG. 5, a vane type variable capacity pump entirely denoted by a reference numeral 20 has a front body 21 and a rear body 22 constituting a pump body. The front body 21 entirely forms a substantially cup-like shape, and a housing space 24 for housing a pump cartridge (pump constituent element) 23 is formed in it. The rear body 22 is combined with the front body 21 and assembled integrally with it to close the open end of the housing space 24. A drive shaft 16 for externally driving a rotor 25 to rotate extends through the front body 21. The rotor 25 has a plurality of vanes **25*a*. The vanes 25*a* are radially held on the outer circumferential portion of the rotor 25 to be movable back and forth in order to form small chambers (to be described later), and come into slidable contact with the inner circumferential surface of the front body 21. The drive shaft 16 is rotatably supported by bearings 26*a*, 26*b*, and 26*c* (the bearing 26*c* is disposed in the rear body 22, and the bearing 16*c* is disposed in a pressure plate 30 to be described later). Reference numeral 26*d*** denotes an oil seal.

Figure 6:
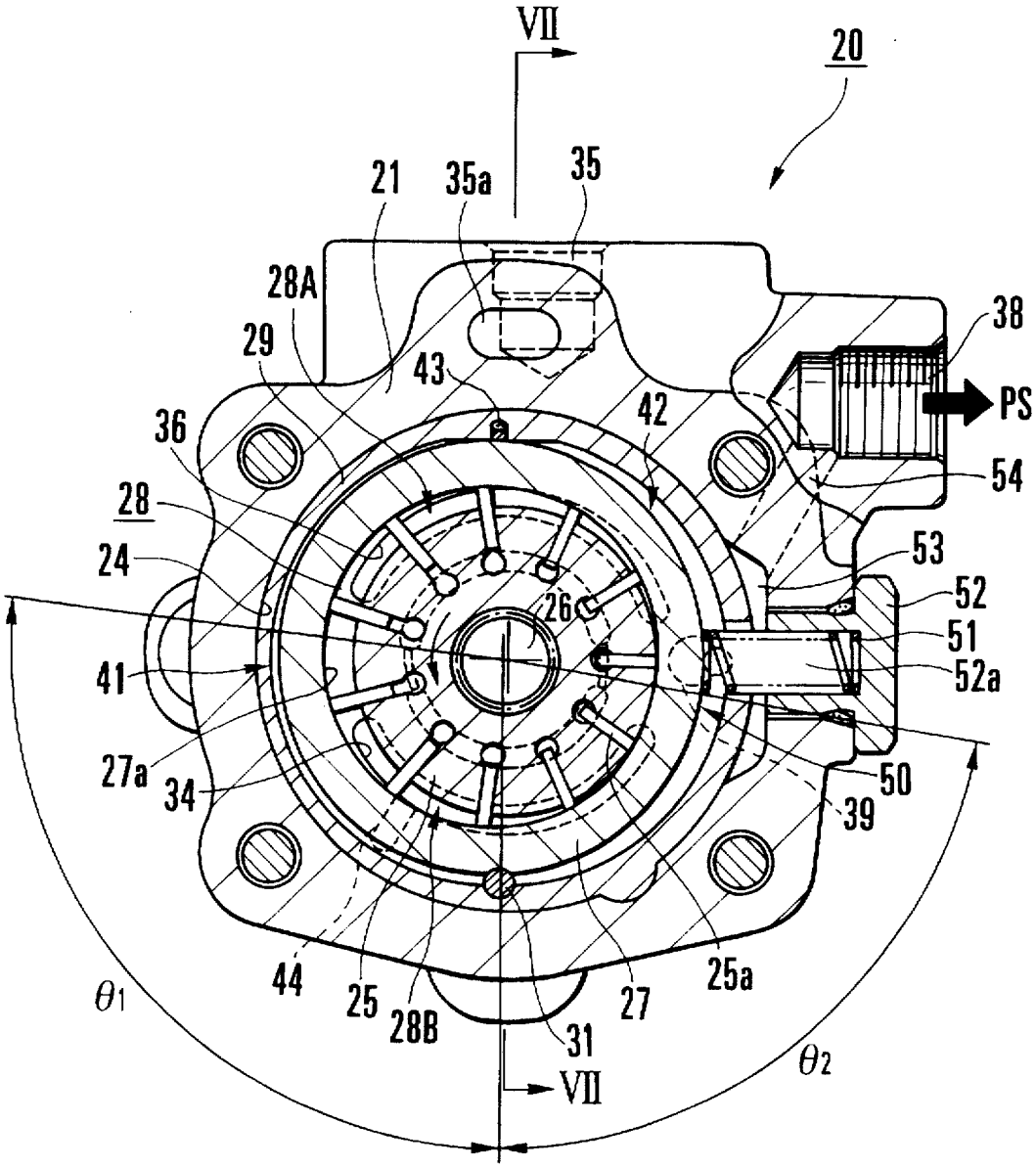
FIG. 6 is a sectional view taken along the line VI—VI of the variable capacity pump shown in FIG. 5.

As shown in FIG. 6, a cam ring 27 has an inner cam surface **27*a* to oppose the outer circumferential portion of the rotor 25, and forms a pump chamber 28 between its inner cam surface 27*a* and the rotor 25. The pump chamber 28 is divided into a plurality of small chambers by the vanes 25*a*. The cam ring 27 is swingable (displaceable) within an adapter ring 29 formed in the housing space 24 to fit on the inner wall portion of the space, so that it can change the volume of the pump chamber 28 corresponding to a portion ranging from the suction region to the discharge region, as will be described later. In the initial state, the cam ring 27 is biased to a position where the volume of the pump chamber 28 corresponding to the portion ranging from the suction region to the discharge region becomes maximum. The adapter ring 29 swingably holds the cam ring 27 within the housing space 24 of the front body 21**.

The pressure plate 30 is pressed against and stacked on the front body 21 of the pump cartridge 23 consisting of the rotor 25, the cam ring 27, and the adapter ring 29. On the opposing side of the pump cartridge 23, the front body 21 and the rear body 22 are integrally assembled while the end face of the rear body 22 is pressed against the opposing side as the side plate. The pressure plate 30 and the rear body 22 stacked on the pressure plate 30 through the cam ring 27 are integrally assembled and fixed while they are positioned in the rotational direction by a rotation preventive means (not shown) and a seal pin 31 (to be described later) that serves also as the axial portion for displacement of the cam ring 27 and the positioning pin.

A pump discharge pressure chamber 33 is formed on the cup-like bottom portion in the housing space 24 of the front body 21 and causes the pump discharge pressure to act on the pressure plate 30. An elongated groove-like pump discharge opening 34 is arcuatedly formed in the pressure plate 30 to guide the fluid (pressure oil) supplied from the pump chamber 28 to the pump discharge pressure chamber 33.

A pump suction port 35 is formed in part of the front body 21. The suction fluid flowing from a tank (not shown) through the pump suction port 35 passes through a pump suction passage **35*a* formed in the front body 21 and passages 35*b* and 35*c* formed in the rear body 22 to be continuous to the passage 35*a*, and is supplied into the pump chamber 28 through the arcuated, elongated groove-like pump suction opening 36 formed in the end face of the rear body 22**.

In FIG. 6, a discharge port 38 opens to face the side portion of the front body 21 in order to supply the pump discharge fluid supplied thereto to a hydraulic equipment, e.g., a power steering system (not shown; denoted by reference symbol PS in FIG. 6). The fluid from the pump chamber 28 is supplied to the discharge port 38 through the pump discharge opening 34, the pump discharge pressure chamber 33, a fluid passage hole 39 formed in the pressure plate 30, a second fluid pressure chamber 42 (to be described later), a spring chamber **52*a*, a notched groove 53 formed in the front body 21, and a passage hole 54 formed in the front body 21. The spring chamber 52*a* accommodates a spring 51 for biasing the cam ring 27, and is plugged with a plug 52**.

Figure 7:
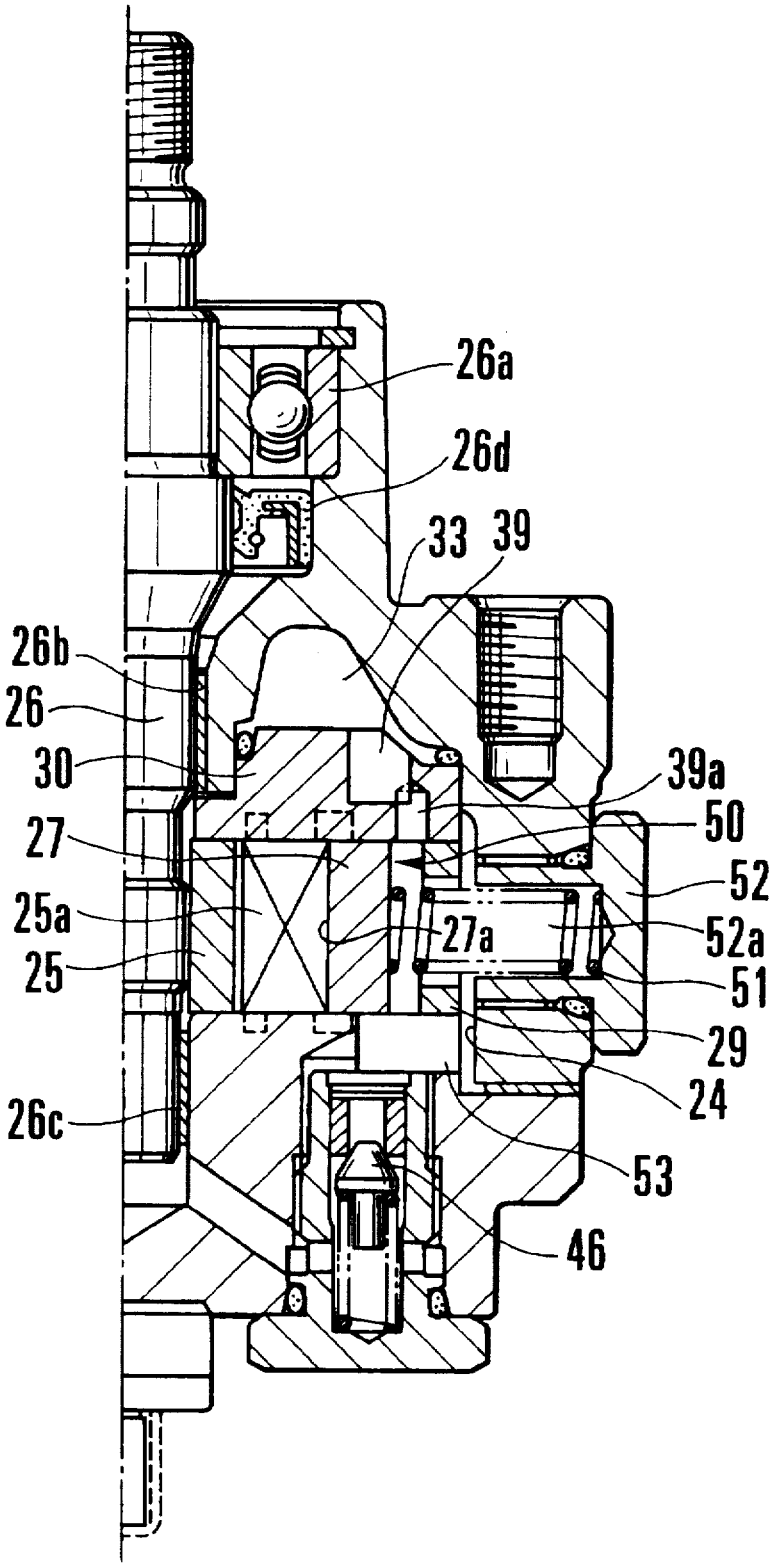
FIG. 7 is a view showing the right half of the section taken along the line VII—VII of FIG. 6.
Figure 8:
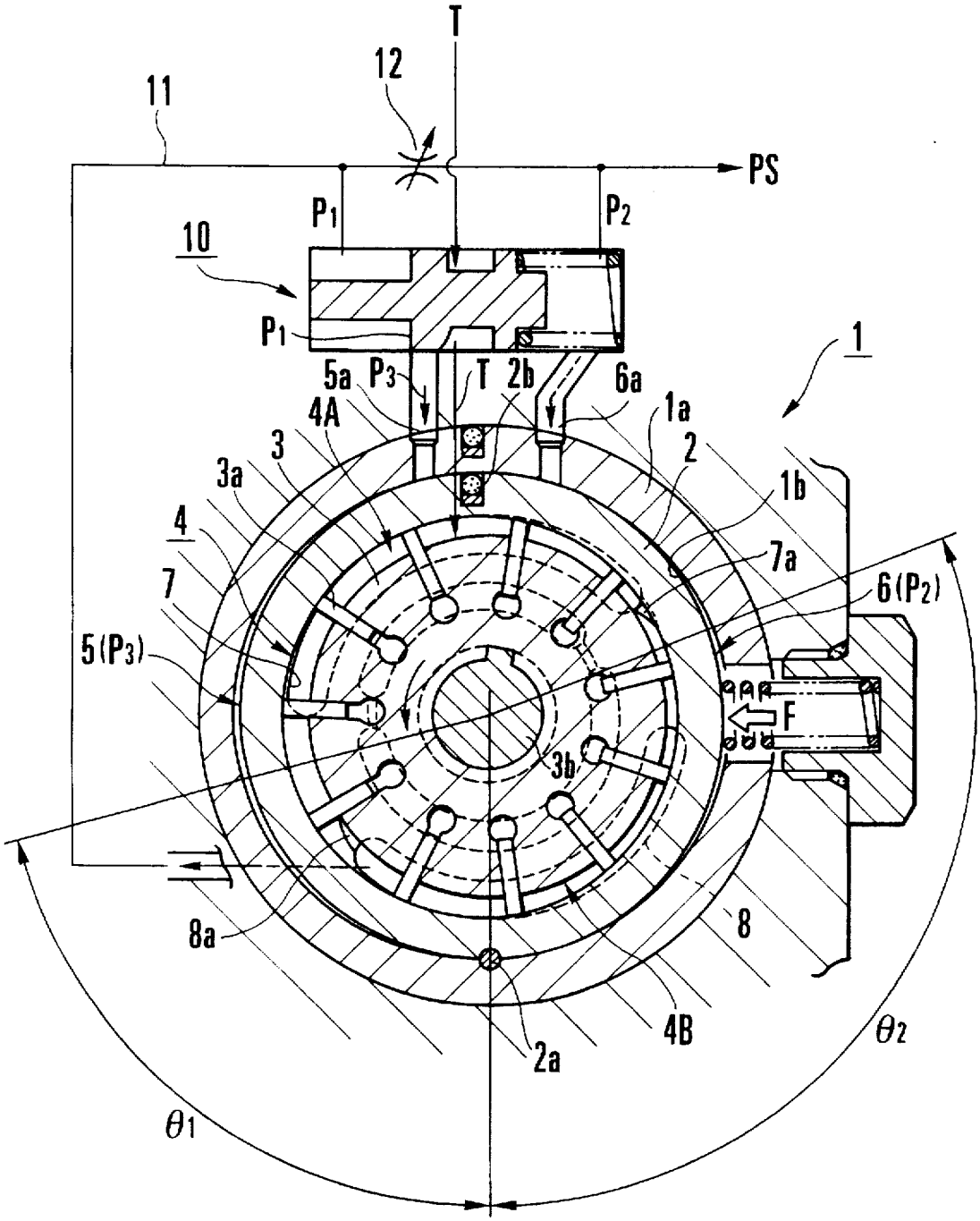
FIG. 8 PRIOR ART
FIG. 8 is a sectional view showing the structure of the main part of a conventional variable capacity pump.

In the pump discharge passages (34, 33, 39, **52*a*, 53, and 54) described above, as shown in FIG. 6, the fluid passage hole 39 which opens to the second fluid pressure chamber 42, and the side portion of the cam ring 27 constitute a variable metering orifice 50 that increases or decreases the opening area of the fluid passage hole 39. As shown in FIG. 7, the variable orifice 50 is constituted to open and close a small-diameter open end 39*a* of the fluid passage hole 39 with the side wall portion of the cam ring 27 with the movement and displacement of the cam ring 27. If the variable orifice 50 is formed into a predetermined shape whose opening and closing amounts are controlled in accordance with the pump discharge fluid pressure, the movement and displacement of the cam ring 27** can be controlled to a desired state, thereby attaining a variety of flow rate characteristics.

Referring to FIG. 6, reference numerals 41 and 42 denote a pair of fluid pressure chambers formed between the inner circumferential portion of the adapter ring 29 and the outer circumferential portion of the cam ring 27. The fluid pressure chambers 41 and 42 are separated by the seal pin 31 swingably supporting the cam ring 27 and a seal member 43 formed at the axisymmetric position to the seal pin 31. A pump discharge pressure on the upstream of the variable orifice 50 in the pump discharge side is supplied to the high-pressure (left side in FIG. 6) fluid pressure chamber 41 through a passage 44. The pump discharge pressure on the downstream of the variable orifice 50 is guided into the other low-pressure fluid pressure chamber 42.

Reference numeral 45 shown in FIG. 5 denotes a fluid pressure detection switch provided to face part of the pump discharge passage, and reference numeral 46 shown in FIG. 7 denotes a relief valve provided to face part of the notched groove 53 of the pump discharge passage. A recessed groove or the like may preferably be formed in the outer circumferential portion of the cam ring 27 to extend for about substantially half its circumference in the circumferential direction such that it can maintain the fluid pressure chamber 41 even when the cam ring 27 comes into contact with the adapter ring 29. The structure of the vane type variable capacity pump 20 as described above is conventionally widely known as indicated in the references enumerated above, and a description thereof other than that concerning the above arrangement will be omitted.

Figure 1:
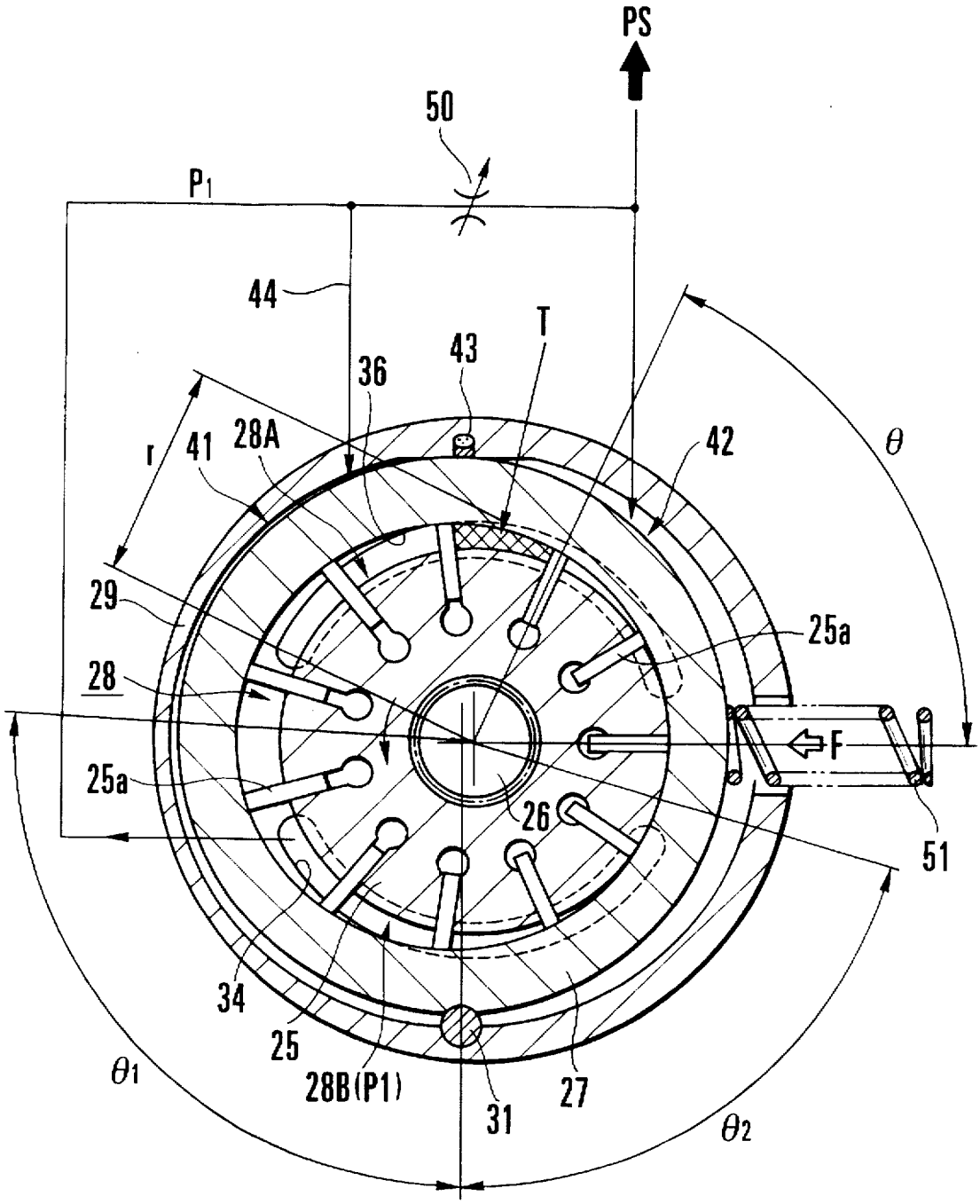
FIG. 1 is a sectional view showing the structure of the main part of a variable capacity pump shown in FIG. 5.

In the variable capacity pump 20 described above, a pump discharge region 28B where a pump discharge pressure P1 in the pump chamber 28 acts in the inner circumferential portion of the cam ring 27 extends on the two sides of the swing direction of the seal pin 31 serving as the swing fulcrum of the cam ring 27, as shown in FIG. 1. More specifically, the pump discharge opening 34 is formed such that a portion (θ1) opposing the high-pressure first fluid pressure chamber 41 extends in a range wider than a portion (θ2) opposing the low-pressure second fluid pressure chamber 42. A pump suction opening 36 is formed in a pump suction region 28A of the pump chamber 28 to keep a predetermined relative positional relationship with respect to the pump discharge opening 34.

Figure 2:
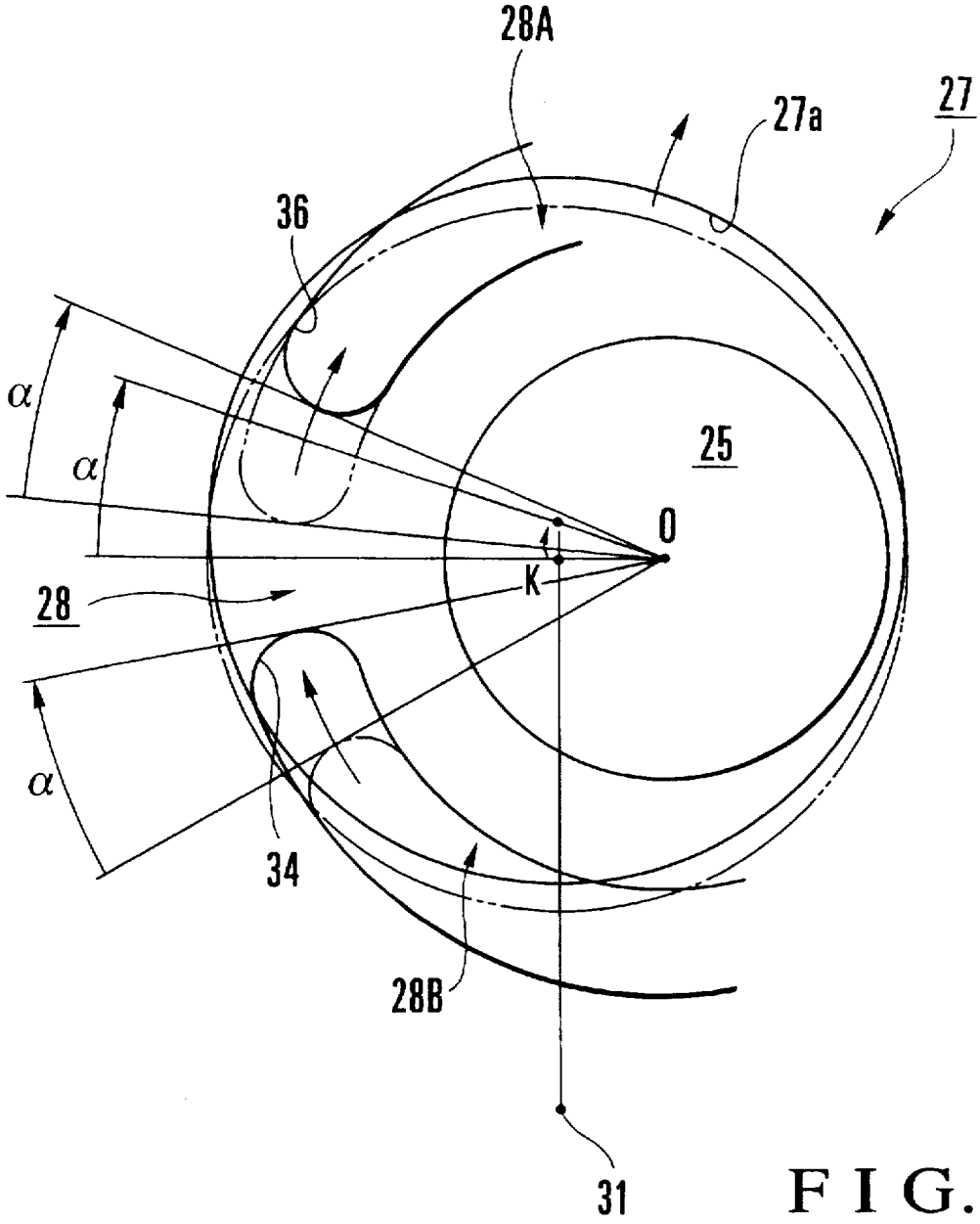
FIG. 2 is a view for explaining the positional relationship between the openings of the present invention.

This will be explained with reference to the view of FIG. 2. In the pump chamber 28 formed between the rotor 25 and the cam ring 27, the pump discharge opening 34 in the pump discharge region 28B and the pump suction opening 36 in the pump suction region 28A are shifted from their positions in the conventional pump structure each by a predetermined angle α in the reverse rational direction of the rotor about a center of the rotor 25 as the center.

A center K of the inner cam surface 27*a* of the cam ring 27 that forms the pump chamber 28 together with the rotor 25 is shifted from its conventional position about the center O of the rotor 25 as the center of rotation to be closer to the pump suction region 28A.

More specifically, as described above, since the openings 34 and 36 are formed to be shifted by the angle α in the reverse rotational direction of the rotor, the internal volume of the small chamber corresponding to the rotation angle of the rotor 25 is changed in accordance with the positions of the openings 34 and 36. Thus, the center K of the cam ring 27 is shifted by rotation through the angle α about the center O of the rotor 25 as the center, in the same manner as the openings 34 and 36, so that the relationship between the radius of the inner cam surface 27*a* of the cam ring 27 and the opening 34, and the relationship between the radius of the inner cam surface 27*a* of the cam ring 27 and the opening 36 become identical with respect to the rotation angle of the rotor.

In particular, as described above, when the ranges of angles on the two sides of the seal pin 31 in the pump discharge region are set to θ1 and θ2 (θ1>θ2), the position of the cam ring 27 relative to the rotor 25 is shifted so that the interior of the small chamber (a space portion formed between one vane 25*a* and a following vane 25*a*) that shifts from the pump suction region to the discharge region will not be set at a negative pressure. With this arrangement, suction and discharge of the pump can be performed appropriately, and pulsation on the pump discharge side is decreased.

To shift the center K of the cam ring 27 described above, the following scheme may be possible. Namely, the pin 31 serving as the swing fulcrum is displaced closer to the center of the cam ring 27 than in the conventional case. This can be achieved by shifting the hole portion of the plate serving as an accepting member of the seal pin 31, or by changing the depth of the recessed portion that holds the pin 31. Alternatively, a position where the inner cam surface 27*a* is to be formed on the inner side of the cam ring 27 may be shifted without changing the outer circumference of the cam ring 27.

The shift amount (displacement amount) of the cam surface 27*a* is determined by change amounts in discharge flow rate in the unloaded state and the maximum loaded state and other conditions on flow rate characteristics, and is not determined by a single condition. In FIG. 2, the broken lines indicate the positions of the respective portions in the conventional pump.

In the structure described above, as shown in FIG. 1, particularly in the pump discharge region 28B corresponding to the pump discharge opening 34, the ranges on the two sides of the swing of a line segment extending through the seal pin 31 as the swing fulcrum and the seal member 43 satisfy θ1>θ2. This relationship is opposite to that of the conventional pump.

Therefore, in this structure, even if fluid pressures before and after the variable metering orifice 50 formed in part of the pump discharge passage are directly introduced as control pressures into the pair of fluid pressure chambers 41 and 42 formed outside the cam ring 27 (described above), the conventional problem of a decrease in discharge flow rate in the loaded state is solved. A control valve thus becomes unnecessary, the cost of the entire pump apparatus can be decreased, and the leakage amount of the fluid in the pump can be decreased.

In this arrangement, the drive torque of the pump in the unloaded state can be decreased, thereby decreasing, e.g., the fuel consumption of an automobile. Since the pump suction opening 36 and the pump discharge opening 34 can be arranged to increase the amount of eccentricity of the cam ring 27 in the loaded state, required flow rate control sensitive to an increase in load pressure accompanying the actuation of a power steering system PS serving as the fluid pressure utilizing equipment can be performed.

In particular, with this arrangement, a swing displacement caused by unbalanced forces acting on the cam ring 27, which is conventionally caused by a pump discharge pressure that increases in the loaded state and poses a problem, can be prevented. For example, the cam ring 27 can be prevented from swinging in a direction to decrease the volume of the pump chamber.

Therefore, the fluid pressures before and after the variable metering orifice 50 on the pump discharge passage can be directly used as the pressures to be introduced to the respective fluid pressure chambers 41 and 42 for swinging the cam ring 27, without using a control valve which is conventionally used to prevent swing displacement caused by the unbalanced forces of the cam ring of this type.

In the unloaded state wherein the power steering system PS is inoperative, since the cam ring 27 is directly swung and displaced in accordance with an increase or decrease in pump discharge pressure, the timing at which the volume of the pump chamber decreases becomes faster than in the conventional pump, so that the pump drive torque in the unloaded state can be decreased. When the power steering system PS is the fluid pressure utilizing equipment, the fuel consumption of the engine can be decreased, and an increase in oil temperature can be suppressed particularly in the low-speed rotation range. As a matter of course, in the loaded state, flow rate characteristics can be obtained in accordance with the load pressure, and load pressure-sensitive flow rate control can be performed in a required state.

Figure 3A:
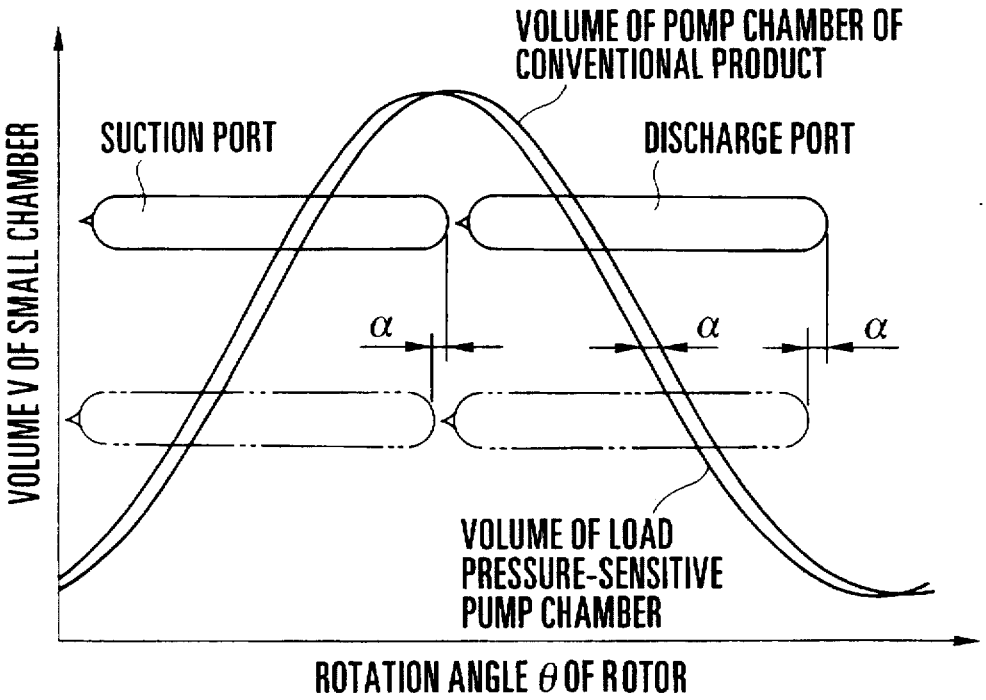
FIGS. 3A and 3B are graphs respectively showing the relationship between the volume of the pump chamber and the rotation angle of the rotor, and the relationship between the radius of the cam surface and the rotation angle of the rotor.
Figure 3B:
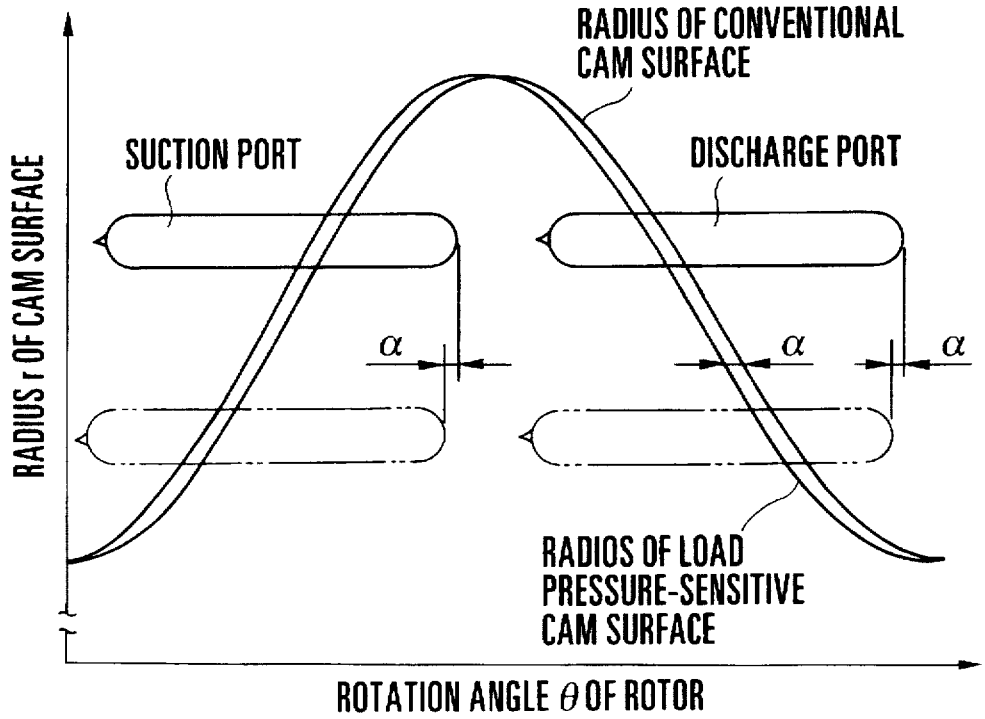

FIGS. 3A and 3B are graphs showing the relationship between a volume V of the small chamber and a rotation angle θ of the rotor, and the relationship between a radius r of the cam surface and the rotation angle θ of the rotor, respectively, of the variable capacity pump 20 described above. The suction port corresponds to the pump suction opening 36, and the discharge port corresponds to the pump discharge opening 34. The small chamber volume V is a volume T of the small chamber between a vane 25*a* at the rotor rotation angle θ to which attention is paid, and a following vane 25*a*. The radius r of the cam surface is a radius from the center of the small chamber at this time.

The pump suction opening 36 (suction port) must be designed such that it closes at a timing when the small chamber capacity becomes maximum, or slightly later than this. The pump discharge opening 34 (discharge port) must be designed such that it opens simultaneously with the closing operation of the suction port, or with the elapse of a short closing time after the suction port is closed.

In FIG. 3A, the suction port and the discharge port almost communicate with each other. However, these two ports are partitioned by two vanes 25*a* constituting the small chambers and are not continuous actually.

As is apparent from FIGS. 3A and 3B, when the pump suction opening 36 and the pump discharge opening 34 are formed to be shifted from their conventional positions, the inner cam surface 27*a* must be shifted due to the pump characteristics.

Figure 4A:
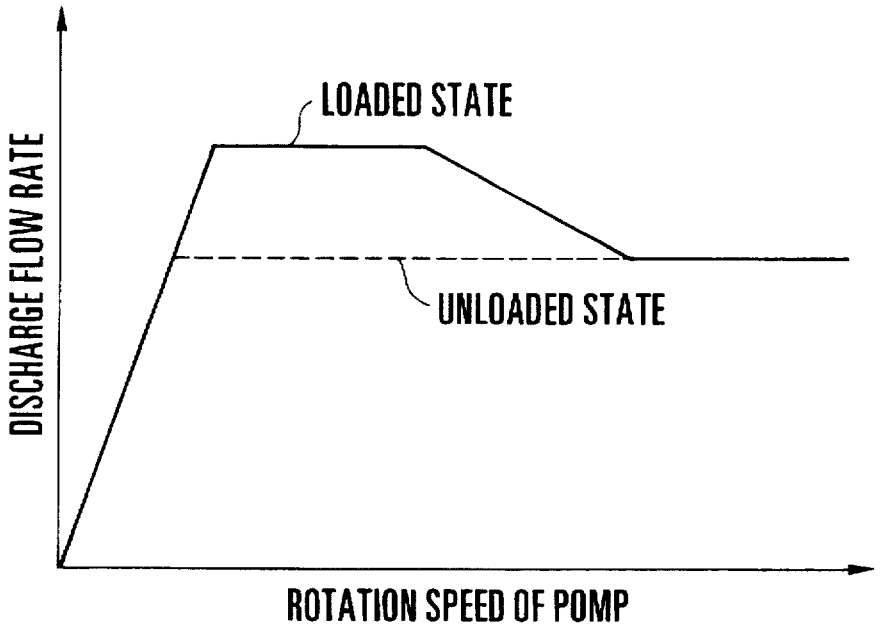
FIG. 4A is a graph showing the flow rate characteristics of a pump according to the present invention.
Figure 4B:
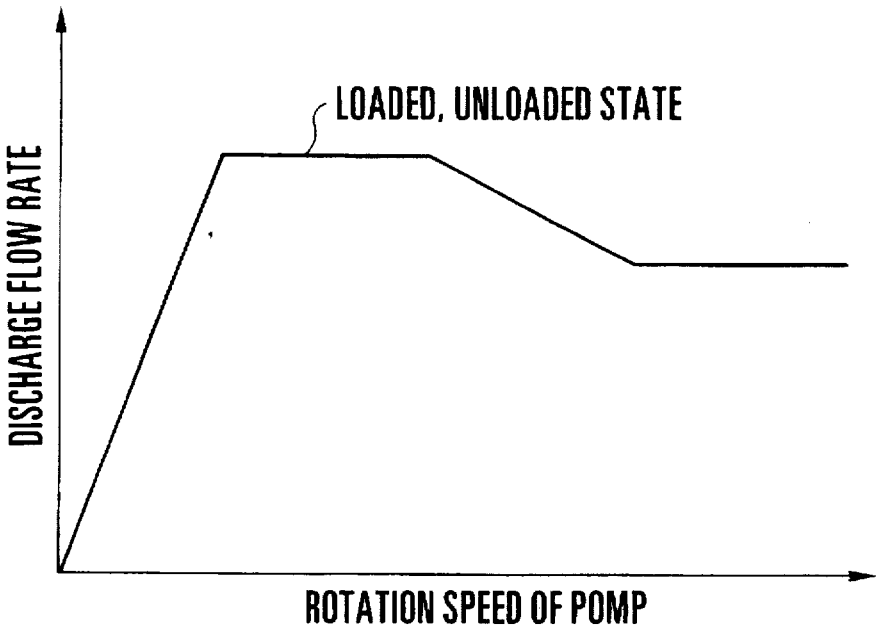
FIG. 4B PRIOR ART
FIG. 4B is a graph showing the flow rate characteristics of a conventional pump.

FIG. 4A is a graph showing the flow rate characteristics of the variable capacity pump according to the present invention in the loaded and unloaded state, and indicates that the discharge flow rate of the pump can be suppressed in the unloaded state. When compared with the conventional pump shown in FIG. 4B in which the pump is actuated in the unloaded state with the same characteristics as in the loaded state, the drive torque of the pump can be apparently decreased.

The present invention is not limited to the structures of the embodiment described above, but the shape, structure, and the like of the respective portions can be freely changed and altered, and various modifications may be made. For example, regarding the pump discharge pressure chamber 33 of the above embodiment, the structure of the passage extending from the chamber 33 to the discharge port 38, the variable orifice 50 midway along this passage, the fluid passages from the pump suction passage to the pump chamber 28, and the like, appropriate modifications may be made.

In the above embodiment, the annular gap for holding the cam ring 27 to be swingable and displaceable is formed between the adapter ring 29 and the rotor 25. However, the present invention is not limited to this, and a cam ring 27 may be held in a front body 21 to be swingable and displaceable.

The vane type variable capacity pump 20 having the above arrangement is not limited to the structure of the embodiment described above. Other than the power steering system PS described, the present invention can be applied to various types of equipments and apparatuses.

As has been described above, in the variable capacity pump according to the present invention, the fluid pressures before and after the variable metering orifice on the pump discharge passage can be directly used as pressures to be introduced to the respective fluid chambers in order to swing the cam ring, without using a control valve which is conventionally used to prevent swing and displacement of the cam ring caused by unbalanced forces.

The pump drive torque in the unloaded state can be decreased. In particular, in the loaded state, unlike in the unloaded state, the flow rate characteristics can be obtained in accordance with the load pressure, so that load pressure-sensitive flow rate control can be performed.

What is claimed is:

1. A variable capacity pump comprising:

a rotor rotatable in a pump body;

a plurality of vanes formed radially on an outer circumferential portion of said rotor and held to be movable back and forth;

a cam ring fitted on said rotor to form a pump chamber on a one-side portion of said outer circumferential portion of said rotor and swingable in said pump body, said pump chamber being divided into a plurality of small chambers by an inner circumferential surface of said pump body and two adjacent ones of said vanes;

biasing means for biasing said cam ring to a position where a volume of said pump chamber of a portion ranging from a pump suction region to a pump discharge region becomes maximum;

variable metering orifice adapted to selectively increase and decrease an opening area and formed midway along a discharge passage of a pressure fluid discharged from said pump chamber;

first and second fluid pressure chambers sealingly divided from each other with means for sealing and formed between said outer circumferential portion of said cam ring and said inner circumferential surface of said pump body to be divided in a biasing direction of said cam ring, said first and second fluid pressure chambers swinging said cam ring by directly introducing input and output fluid pressure of said metering orifice thereinto, respectively;

pump suction opening and pump discharge opening open to said pump suction region and said pump discharge region, respectively of said pump chamber, to have opening areas that are changed by a swing of said cam ring, at least said pump discharge opening being formed in a range where a portion thereof opposing said first fluid pressure chamber is wider than a portion thereof opposing said second fluid pressure chamber;

a seal pin formed in said pump body to swing and support said cam ring;

a seal member which is formed in said pump body to oppose said seal pin and with which said outer circumferential portion of said cam ring comes into slidable contact during swing, and wherein said first and second fluid pressure chambers are divided by said seal pin and said seal member.

2. A variable capacity pump comprising:

a rotor rotatable in a pump body;

a plurality of vanes formed radially on an outer circumferential portion of said rotor and held to be movable back and forth;

a cam ring fitted on said rotor to form a pump chamber on a one-side portion of said outer circumferential portion of said rotor and swingable in said pump body, said pump chamber being divided into a plurality of small chambers by an inner circumferential surface of said pump body and two adjacent ones of said vanes;

biasing means for biasing said cam ring to a position where a volume of said pump chamber of a portion ranging from a pump suction region to a pump discharge region becomes maximum;

variable metering orifice adapted to selectively increase and decrease an opening area and formed midway along a discharge passage of a pressure fluid discharged from said pump chamber;

first and second fluid pressure chambers sealingly divided from each other with means for sealing and formed between said outer circumferential portion of said cam ring and said inner circumferential surface of said pump body to be divided in a biasing direction of said cam ring, said first and second fluid pressure chambers swinging said cam ring by directly introducing input and output fluid pressure of said metering orifice thereinto, respectively;

pump suction opening and pump discharge opening open to said pump suction region and said pump discharge region, respectively of said pump chamber, to have opening areas that are changed by a swing of said cam ring, at least said pump discharge opening being formed in a range where a portion thereof opposing said first fluid pressure chamber is wider than a portion thereof opposing said second fluid pressure chamber, wherein when said portion of said pump discharge opening opposing said first fluid pressure chamber is wider than said portion thereof opposing said second fluid pressure chamber by an angle $2\alpha$, said cam ring is supported such that a center of a cam surface on an inner circumferential portion thereof is shifted to be closer to said pump suction region by an angle $\alpha$ with respect to a center of said rotor as a reference.

3. A variable capacity pump comprising:

a rotor rotatable in a pump body;

a plurality of vanes formed radially on an outer circumferential portion of said rotor and held to be movable back and forth;

a cam ring fitted on said rotor to form a pump chamber on a one-side portion of said outer circumferential portion of said rotor and swingable in said pump body, said pump chamber being divided into a plurality of small chambers by an inner circumferential surface of said pump body and two adjacent ones of said vanes, wherein said cam ring is supported such that a center of a cam surface of an inner circumferential portion thereof that forms said pump chamber together with said rotor is shifted to be closer to a pump suction region with respect to a center of said rotor as the reference;

biasing means for biasing said cam ring to a position where a volume of said pump chamber of a portion ranging from said pump suction region to a pump discharge region becomes maximum;

variable metering orifice capable of increasing or decreasing an opening area and formed midway along a discharge passage of a pressure fluid discharged from said pump chamber;

first and second fluid pressure chambers sealingly divided from each other with sealing means and formed between said outer circumferential portion of said cam ring and said inner circumferential surface of said pump body to be divided in a biasing direction of said cam ring, said first and second fluid pressure chambers swinging said cam ring by directly introducing input and output fluid pressure of said metering orifice thereinto, respectively; and, pump suction opening and pump discharge opening open to said pump suction region and said pump discharge region, respectively of said pump chamber, to have opening areas that are changed by a swing of said cam ring, at least said pump discharge opening being formed in a range where a portion thereof opposing said first fluid pressure chamber is wider than a portion thereof opposing said second fluid pressure chamber, wherein when said portion of said pump discharge opening opposing said first fluid pressure chamber is wider than said portion thereof opposing said second fluid pressure chamber by an angle $2\alpha$, said cam ring is supported such that a center of a cam surface on an inner circumferential portion thereof is shifted to be closer to said pump suction region by an angle $\alpha$ with respect to a center of said rotor as a reference.

4. A pump according to claim 3, wherein said pump suction opening is formed in a range where a portion thereof opposing said second fluid pressure chamber extends wider than a portion thereof opposing said first fluid pressure chamber.

* * * * *

UNITED STATES PATENT AND TRADEMARK OFFICE

CERTIFICATE OF CORRECTION

PATENT NO. : 5,895,209

DATED : April 20, 1999

INVENTOR(S) : Miyazawa

It is certified that error appears in the above-identified patent and that said Letters Patent is hereby corrected as shown below:

In column 7, line 42, delete "center of the rotor 25 as the center" and insert -- center O of the rotor 25 as the center -- .

In column 11, line 26, delete "thereinto, respectively:" and insert -- thereinto, respectively; --.

Signed and Sealed this

Sixth Day of February, 2001

*Attest:*

Q. TODD DICKINSON

*Attesting Officer*

*Director of Patents and Trademarks*